United States Patent [19]

Dingman

[11] 4,241,655

[45] Dec. 30, 1980

[54] PRINTER WITH INDEXED ORIENTATION OF PRINT HEAD RELATIVE TO WEB MOVEMENT

[75] Inventor: Arthur E. Dingman, Little Ferry, N.J.

[73] Assignee: Autographic Business Forms, Inc., Mahwah, N.J.

[21] Appl. No.: 14,556

[22] Filed: Feb. 23, 1979

[51] Int. Cl.[3] ..... B41J 3/56

[52] U.S. Cl. ..... 101/79; 101/93.27; 101/93.37; 101/102; 101/110; 101/292; 101/228

[58] Field of Search ..... 101/66, 67, 70, 72, 101/78–82, 84–87, 93.35–93, 36, 93, 37, 93.41, 95, 90, 96, 102, 110, 93.27, 288, 292–295, 368, 316

[56] References Cited

U.S. PATENT DOCUMENTS

| | | | |
|---|---|---|---|
| 3,254,596 | 6/1966 | Shorp et al. | 101/102 |
| 3,306,186 | 2/1967 | Voos et al. | 101/110 X |
| 3,351,005 | 11/1967 | Giori | 101/70 X |
| 3,376,811 | 4/1968 | Grintz | 101/288 X |
| 3,730,085 | 5/1973 | Beck | 101/93 X |
| 3,837,276 | 9/1974 | Reichert | 101/316 X |
| 4,034,607 | 7/1977 | Cartwright et al. | 101/316 X |

*Primary Examiner*—Edward M. Coven

*Attorney, Agent, or Firm*—Hopgood, Calimafde, Kalil, Blaustein & Lieberman

[57] ABSTRACT

The invention contemplates a non-rotary printing machine which accommodates continuously moving web along a single path of movement, for recycled precision imprinting of specially characterized information; the printing involves cooperative use of a printing-head unit on one side of the web and a printing-hammer unit on the other side of the web, and these units are indexibly positionable to enable the machine to print the characterized information in a selected one of at least two different alignment orientations with respect to the direction of web movement.

25 Claims, 9 Drawing Figures

PRINTER WITH INDEXED ORIENTATION OF PRINT HEAD RELATIVE TO WEB MOVEMENT

BACKGROUND OF THE INVENTION

The invention relates to a non-rotary printing machine particularly applicable to recycled precision imprinting of specially characterized information on web material, which may be continuous web, moving continuously through the machine. More specifically, the invention is applicable to printed insertion of limited composition onto base-printed documents, i.e., those which have already been printed with static or master format, as for example letterheads, billheads, greeting cards, bank checks, hospital forms, and other administrative or commercial papers, as to which documents merely a line or a limited number of lines of further identifying content is to be added for specific localized or personal use.

In today's increasingly automated business world, wherein checks and other business documents must be printed with machine-readable characters, as in the case of the MICR system, strict registration standards must be adhered to, and the demand is for faster production, quicker set-up time, minimum stock (web) waste, and use of less-skilled operators—in short, further cost reduction in regard to machine investment and space requirements, without sacrifice of the foregoing other requirements.

A machine which has been able to satisfy most of the foregoing and other requirements is as described in U.S. Pat. No. 3,254,596, wherein provision is made for the machine to accept feed of web material via a selected one of two orthogonally related feed systems having parts which intersect in a printing zone between a printing-head unit and a printing-hammer unit. Necessarily, this existing machine must be relatively massive, complex and expensive, involving as it does, two feed systems on different directional alignments, and all the drive coordination, phase and marginal adjustments, etc. that must be at least in duplicate (and suitably interconnected or interconnectable) to assure requisite synchronization and other aspects of a precision job, whatever the selected orthogonal direction of web feed.

BRIEF SUMMARY OF THE INVENTION

It is an object of the invention to provide an improved machine of the character indicated which will meet above-stated demands.

Another object is to provide such a machine which will exceed capabilities of present machines.

A specific object is to provide a machine with the performance capabilities of the machine of said U.S. Pat. No. 3,254,596, but requiring and accepting only one direction of web movement through the machine; stated in other words, it is a specific object, in a printing machine having but a single direction of web feeding, to provide a single printing means with inherent capability of printing with equal efficacy, regardless of whether the elongation axis of the intelligence to be printed is aligned with or transverse to the path of web movement, and regardless of ultimate document size.

Another specific object is to meet the above objects with mechanism which is optionally mountable (a) upon its own base, as for off-line use where convenient for particular job or shop requirements, or (b) for direct incorporation as a functioning component of an on-line machine, as for example in the specialized imprinting of one or more of the plural webs accommodated in the on-line continuous operation of a multiple-web collating machine.

A further specific object is to provide a printing machine of the character indicated in modular form, adaptable in multiple in an existing on-line machine, as for the different specialized printing of one or more parts of the multiple-part forms to be integrated in the on-line continuous operation of a collating machine.

It is also an object to meet the above objects with a machine having inherent capability of printing (a) with MICR numbers, with or without serialized imprinting of Arabic numbers, (b) with cast type (printing slugs), with or without serialized imprinting of numbers, and (c) with flexible adaptability to printing with magnetic ink or any other desired pigment.

The foregoing and other objects and features of the invention are achieved in a machine having means for continuously feeding web material along a single path of movement, for recycled precision imprinting of specially characterized information, utilizing a printing-head unit on one side of the web and a printing-hammer unit on the other side of the web. These cooperating units are indexible about an indexing axis normal to the web at the printing zone, to enable the machine to print characterized information in a selected one of at least two different alignment orientations with respect to the direction of web movement. Provision is made for accurately synchronized cyclic operation of the two indexed units, regardless of their selected orientation or lateral position with respect to the path of web movement. The invention is optionally usable in on-line and off-line applications and incorporates features of simplified access for set-up, maintenance and adjustment, to the end that a maximum variety of precision-printed different products may be efficiently and economically produced.

DESCRIPTION OF A PREFERRED EMBODIMENT

A preferred embodiment is shown, for illustrative purposes only, in the accompanying drawings which are to be taken in conjunction with ensuing text. In said drawings.

Figure 1:
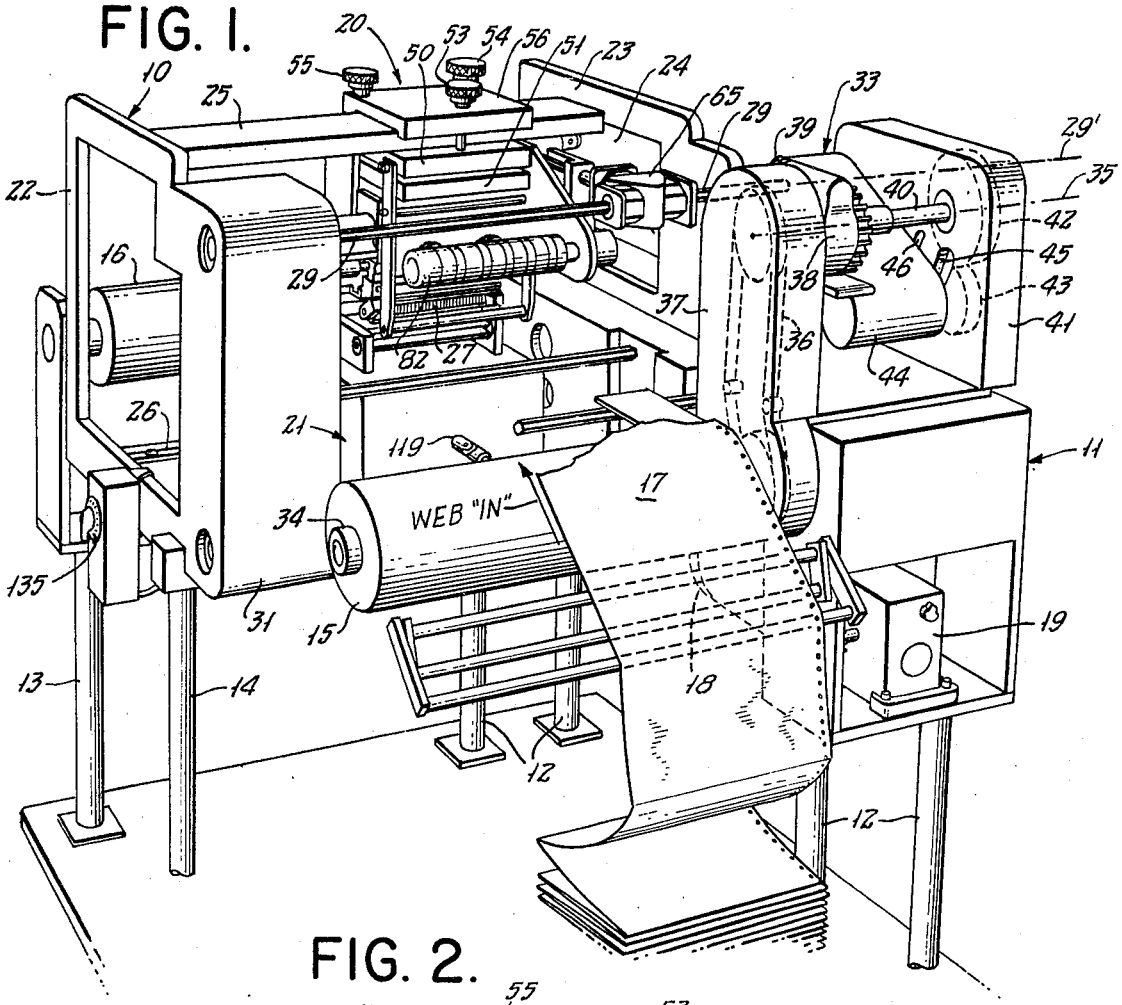
FIG. 1 is a perspective view of a printing machine of the invention, set up for the situation in which the direction of characterized printing is transverse to the direction of web feed through the machine, the view being from the operator's side and in the in-feed direction for web advance through the machine.
Figure 2:
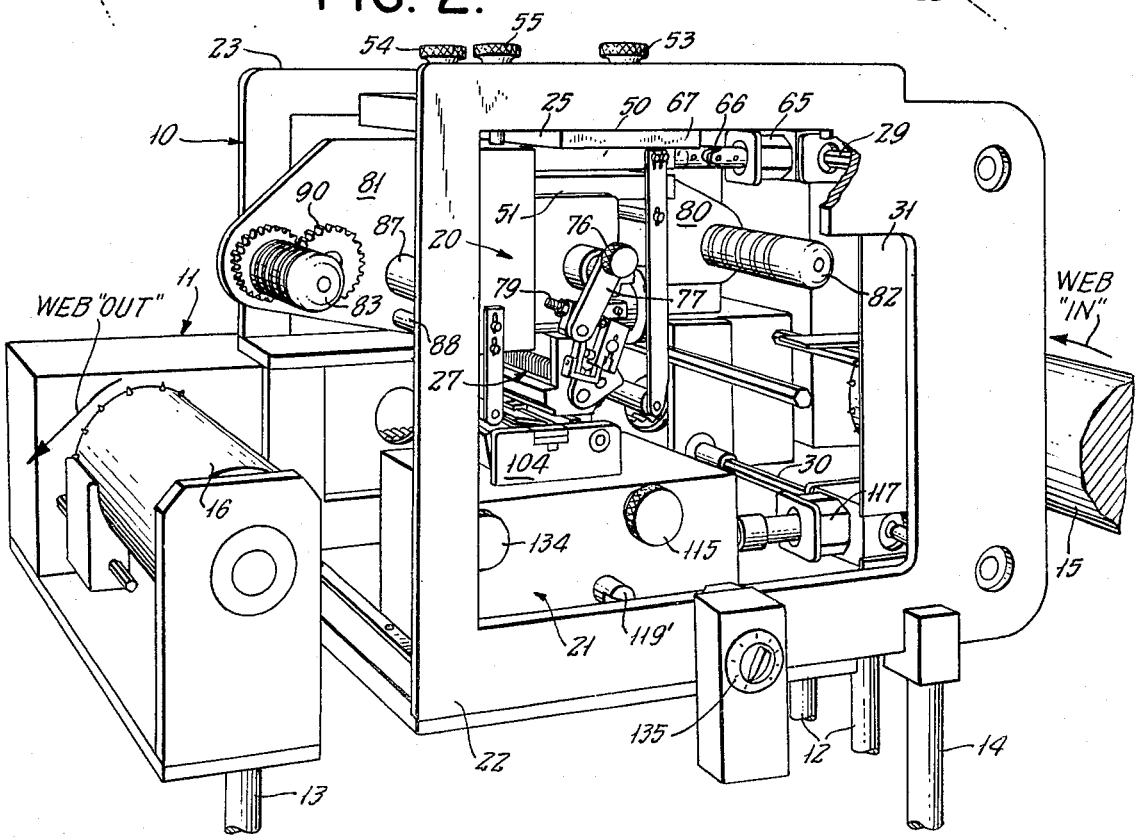
FIG. 2 is another perspective view of the machine as set up in FIG. 1, but from a different aspect, to reveal further detail.

Referring initially to FIGS. 1 and 2, the invention is shown in application to a printing-machine module 10, mounted to frame structure 11 for off-line use. The frame structure 11 includes spaced pairs of rear legs 12 and a front leg 13, and a further leg 14 provides floor support for the operator's side of module 10, which would otherwise be cantilevered from its back-side support along the frame structure 11. The frame structure 11 provides journal support for "IN" and "OUT" feed rolls 15–16 for the continuous longitudinal feed of web material 17 having marginal apertures for positive and synchronized register with sprocket pins shown at one margin of each of the rolls 15–16. Between rolls 15–16, web 17 extends horizontally through the printing module 10, but for a better showing of parts, web 17 has been broken at entrance into module 10 in FIG. 1. The rear part of frame structure 11 is horizontally elongate and provides underslung support for a motor 18 and associated reduction-gear means 19 for various drives to rolls 15–16 and to the module 10. Among these drives is a 1:1 sprocket connection between rolls 15–16, set to provide the span of web 17 within module 10 with a predetermined degree of slack such that transient print impressions can be made upon web 17 without interrupting continuous web movement at rolls 15–16.

The module 10 contains an upper or printing-head unit 20 and a lower or printing-hammer unit 21, all within the generally rectangular prismatic volume defined by an open supporting framework, comprising an open rectangular front frame member 22, a rectangular rear frame 23 including an opening 24, and upper and lower connecting members 25–26. The printing-head unit 20 positions a print head 27 with a face of characterized indicia in a horizontal plane adjacent passing web 17, and head 27 is adjustably positionable via the adjustably clamped suspension of unit 20 from upper frame member 25, the latter serving as a guide, precisely orthogonal (i.e., transverse) to the direction of web movement past head 27, and parallel to the printing face of head 27. The printing-head unit 21 is also adjustably positionable via an adjustably clamped support on transverse guide means forming part of the lower frame member 26.

Each of the units 20–21 contains mechanism to be cyclically operated, once per print cycle, and drive rotation for the purpose is picked off from an upper shaft 29 and a lower shaft 30, journaled in frames 22–23 on parallel horizontal axes which are respectively above and below the web 17. Shafts 29–30 are coupled by a toothed-belt connection within a protective casing 31 at the operator's side, and the upper shaft 29 extends through the rear frame 23 for driven connection to drive mechanism of the frame structure 11, via a power take-off unit 33. As shown, the drive shaft for the "IN"-feed roll 15 is cantilevered in its support from frame structure 11, roll 15 being removably clamped upon and keyed to its shaft, at 34, in the manner of a typical collating-machine roll. The power take-off unit 33 makes an initial 1:1 transfer of rotation from the shaft for roll 15 to an upper intermediate axis 35 of shaft alignment, said 1:1 transfer being via sprocket-chain means 36 contained within a protective enclosure 37. At the alignment 35, differential-gear means 38 having provision for manual adjustment at 39 enables precise adjustment of the phase of rotation of a shaft 40 with respect to rotation of roll 15. Within a removable protective enclosure 41, shaft 40 projects to removably mount a single change gear 42, of size selected to correlate web advance with the print cycle, for particular job requirements. Finally, rotation of shaft 40 is conveyed via gear 42 to the upper shaft 29 via a pinion 43 in constant mesh with change gear 42; the shaft for pinion 43 is journaled at the end of an arm unit 44 which is pivotable about the axis of shaft 29 (the alignment of which is indicated at 29′ in FIG. 1), and a 1:1 toothed-belt coupling from the pinion shaft to shaft 29 extends along and is swingable with pivoted adjustment of arm unit 44. In FIG. 1, a wide arcuate slot 45 is visible for accommodating swing of the pinion shaft about the axis of shaft 29, depending upon the swing needed to adapt for meshing pick-off of a particular selected size of change gear 42, and a smaller arcuate slot 46 concentrically inward of slot 45 enables arm unit 44 to be clamped in its adjusted-swing position.

Figure 3:
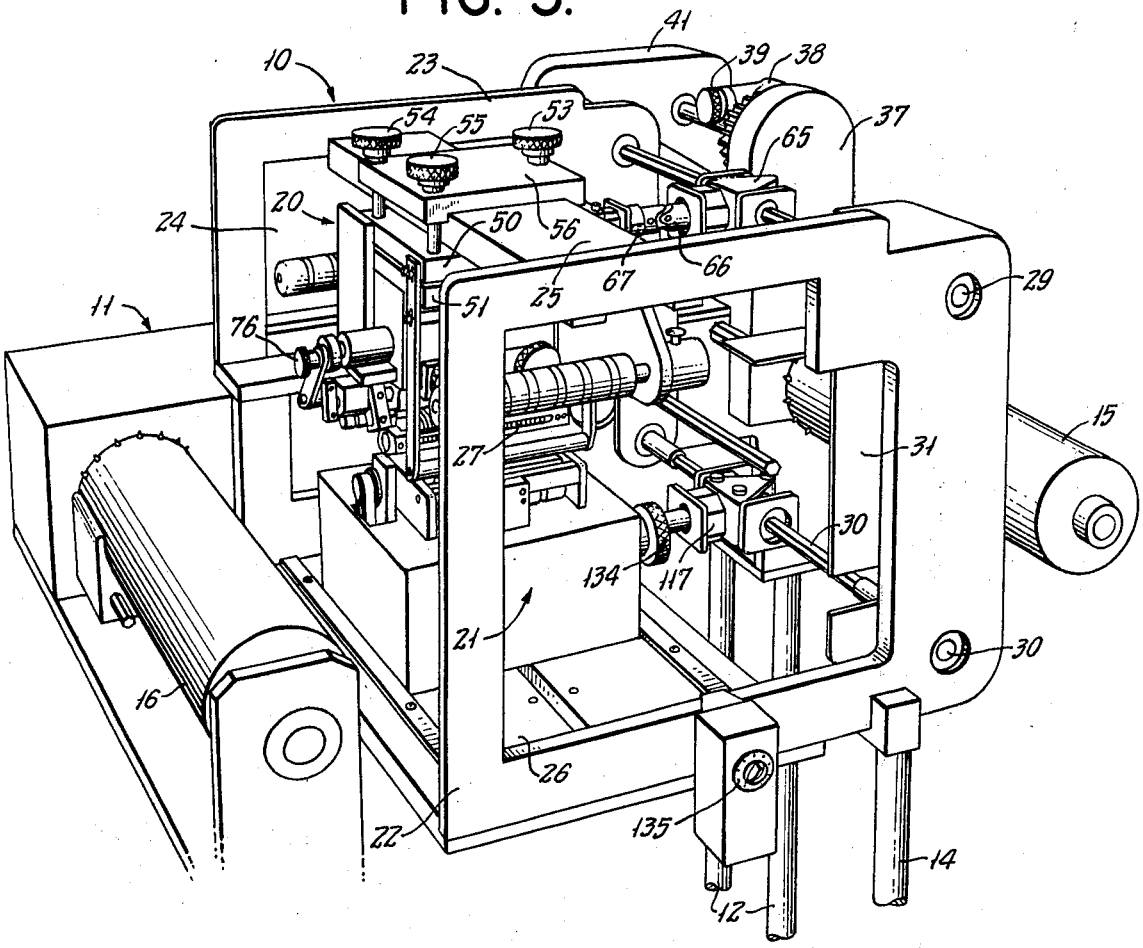
FIG. 3 is a perspective view of the machine of FIG. 1, taken from the aspect of FIG. 2 but for a different set up wherein the direction of characterized printing is aligned with the direction of web feed through the machine.

It has been indicated to be a feature of the invention that each of the units 20–21 is selectively indexible about an axis perpendicular to the plane of print-impression, i.e., about a vertical axis. This indexing is in addition to the adjustable transverse positioning feature already described, and the effecting of an indexing change from the print orientation shown and described for FIGS. 1 and 2 is illustrated in FIG. 3, wherein the printing-head unit 20 is seen to have been displaced 90 degrees, to position print head 27 so that the alignment of its printing indicia is in register with the direction of web advance through module 10. At the same time, FIG. 3 illustrates a similar indexing displacement of the printing-hammer unit 21 from its orientation of FIGS. 1 and 2. A more detailed appreciation of the structure and interrelationship of indexible units 20–21 will be had from FIG. 4 and from the following separate descriptions of these units, in further conjunction with FIGS. 5 and 6 (as to unit 20), and in further conjunction with FIGS. 7 and 8 (as to unit 21), respectively.

THE PRINTING-HEAD UNIT 20

Figure 4:
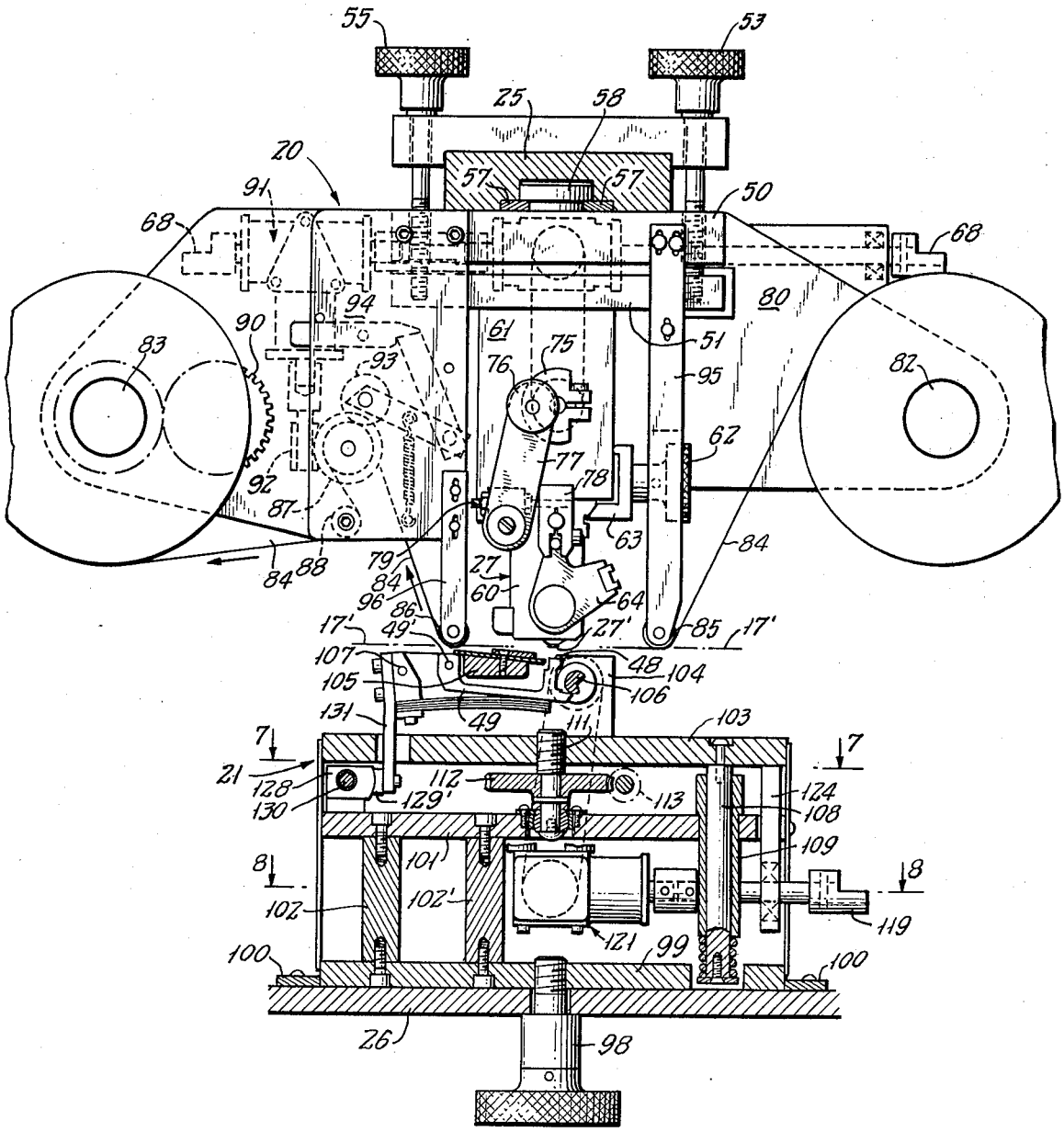
FIG. 4 is an enlarged side view in elevation of printing-head and printing-hammer units of the machine of FIG. 1, certain parts being broken-away at an inner section, for better showing of detail.

In FIG. 4, the printing-head unit 20 is shown clamped to and suspended from the upper transverse frame member 25, in the orientation discussed in connection with FIGS. 1 and 2, wherein the printing head 27 presents the alignment of its characterized printing face 27′ in the direction orthogonal to the path of movement of web 17, and to avoid confusion in FIG. 4, the web 17 will be understood to extend continuously on the horizontal-plane alignment between spaced phantom lines 17′, i.e., between the characterized printing face 27′ and the anvil 48 of the hammer 49 of unit 21.

Figure 5:
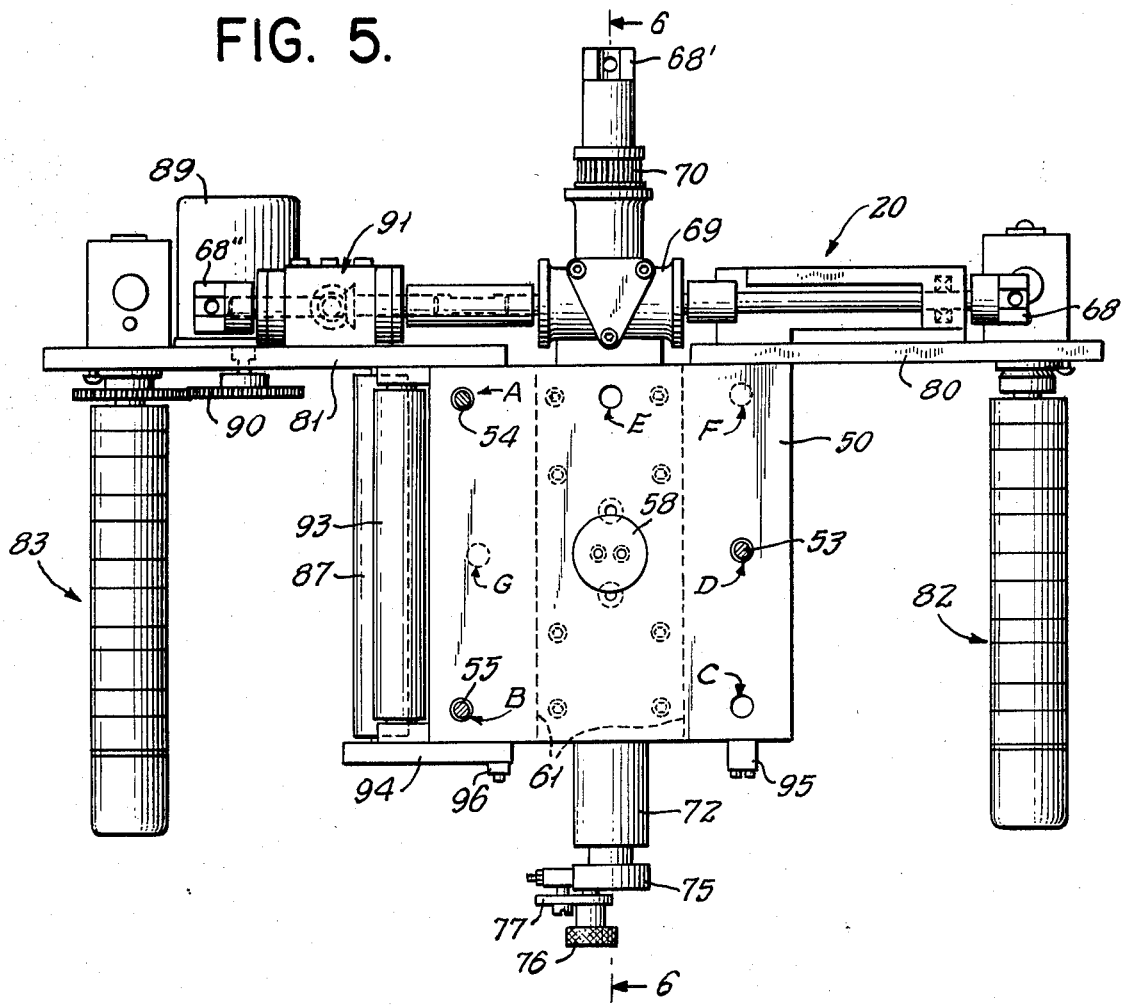
FIG. 5 is a plan view of the printing-head unit of FIG. 4.
Figure 6:
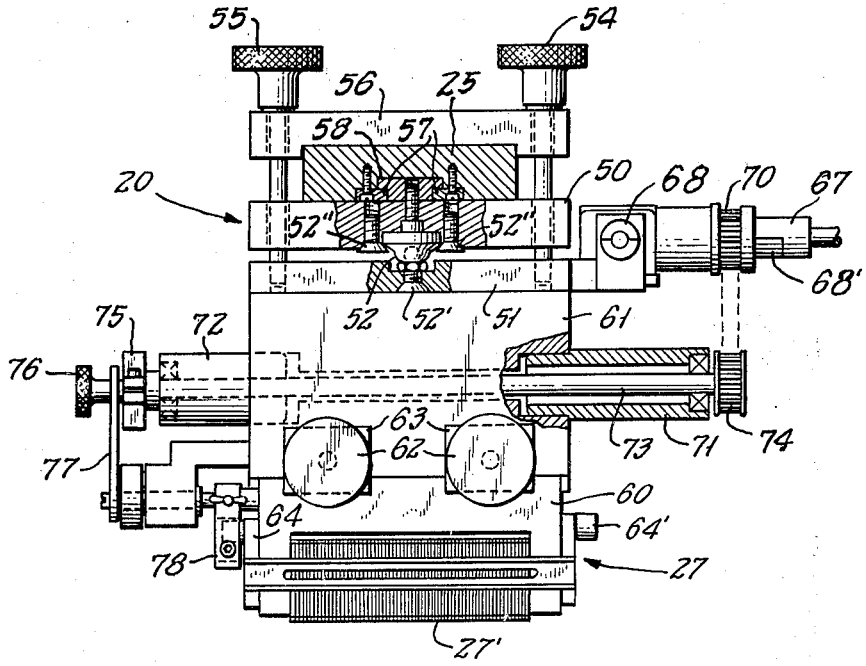
FIG. 6 is a right-end view in elevation of the printing-head unit of FIG. 4.

Referring additionally to FIGS. 5 and 6 in the context of the upper half of FIG. 4, the printing-head unit 20 will be seen to comprise a primary frame centered upon an upper square base plate 50, and a secondary frame centered upon a lower square base plate 51, in substantial register with and beneath plate 50. Ball-and-socket means including a pad 52 at the center of the lower surface of plate 50 permits a limited range of universal-action leveling adjustment of the lower plate 51 when clamped to the upper transverse connecting member 25 of the main frame of the machine; the "ball" of the ball-and-socket means will be understood to be secured (by means 52') to plate 51, and the base or pad of the "socket" will be understood to be secured (by means 52") to plate 50, with the "socket" sufficiently embracing the "ball" as to enable means 52 to axially retain plates 50–51, as during an indexing operation. As shown, three elongate bolts 53–54–55, with enlarged knob heads for easy manual operation, are carried by a clamp saddle 56 which is grooved for transversely guided positioning along member 25, the bolts 53–54–55 being accommodated at opposed marginal regions of the saddle, i.e., outside the lateral limits of member 25. More specifically, the lower base plate 51 will be understood to have three tapped bores at corner locations A–B–C, each adapted to receive threaded engagement by one of the clamp bolts, and the upper base plate 50 has corresponding but enlarged bores to clear any inserted clamp bolt; in addition, plate 51 is similarly tapped at locations D and E, centrally of the side-margin regions opposed to locations A–B and to locations B–C, respectively, while the upper plate 50 has corresponding but bolt-clearing bores.

The described arrangement of bores at locations A . . . E in plates 50–51 will be seen to cooperate with the three locations of bolts 53–54–55 in the clamp saddle 56 for each of two 90-degree indexed relations of plates 50–51 (i.e., of the printing-head unit 20) with respect to the saddle 56. In the indexed relation shown in FIGS. 1, 2, 4, 5 and 6, the elongation of print head 27 is transverse to the path of web displacement, with bolts 53–54–55 received and set at locations D–A–B, respectively, the adjustment of bolts 53–54–55 being such as to achieve correct leveling of the lower plate 51 when clamped, so as to assure high-quality uniform printing of the entire characterized face 27', as will be later more fully explained. And in the 90-degree indexed relation shown in FIG. 3, it will be understood that the same bolts 53–54–55 will be similarly received and set at locations E–B–C, respectively. To facilitate indexing about the central alignment of frame member 25, the latter has an elongate effectively dovetail-groove underside, involving inlaid spaced shoulder rails 57, for engaged retention of a flanged circular bushing 58 bolted to the center of the upper surface of base plate 50.

The printing head 27 may be of the variety shown in connection with the printing machine of said U.S. Pat. No. 3,254,596, in which case it comprises a plurality of adjacent print wheels assembled on a common shaft between spaced arms of a U-shaped frame 60, having an elongate dovetail formation for adjustable mounting purposes; in FIG. 4, such mounting is made to the lower end of a prismatic block 61 which is secured to and extends the full width of the lower base plate 51 (see dashed lines 61 in FIG. 5). Two knob-headed spaced bolts 62 threaded to block 61 secure the dovetail of frame 60, via clamp members 63. Depending upon the print job to be done, some or all of the print wheels of head 27 may establish separate digit positions of a serial-numbering system, indexing once per print cycle and driven by angular oscillation of an index-actuating bellcrank 64, in synchronism with the print cycle.

In accordance with a feature of the invention, the synchronizing drive needed for serial-number indexing of head 27, e.g., once per print cycle, is continuously derived from rotation of the upper shaft 29 and is available regardless of the transverse position at which the printing-head unit 20 is clamped to the frame member 25 and regardless of which of the indexed positions, FIG. 1 or FIG. 3, is being utilized for a particular run of the machine. To this end, a bevel-gear pick-off unit 65 has keyed slidable engagement with shaft 29 and picks off shaft (29) rotation regardless of its position along the shaft. The output of unit 65 is rotation (1:1 in relation to shaft 29) of an output shaft equipped with a universal joint 66 and with a coupling element 67 which is adapted for selective fastening to a selected one of two or more similar coupling elements 68–68'–68" forming part of the printing-head unit 20. For the FIG. 1 indexed orientation of head unit 20, such coupling is made at 67–68, imparting continuous rotation to a straight shaft connection to coupling element 68"and to a 90-degree (bevel-gear) connection 69 to the coupling element 68'; for the FIG. 3 indexed orientation of head 20, such coupling is made at 67–68'. In either event, it will be understood that it is a simple single screwdriver operation to release or secure a given one of the rotary coupling engagements to head unit 20, and that in any event, once thus coupled, continuous drive is imparted to a toothed wheel 70, for synchronized serial-number advancement via means to be discussed.

As best seen in FIG. 6, outwardly cantilevered tubular extensions 71–72 of the block 61 provide spaced bearing support for a shaft 73, which is equipped at one end with means 74 for 1:1 toothed-belt drive from wheel 70; at its other end, shaft 73 carries a crank 75 releasably pinned at 76 to a link 77, by which oscillating rotary motion is imparted to rocker-arm means 78, via an adjustable-amplitude connection 79. Finally, rocker-arm means 78 has pin-and-slot connection to the print-wheel indexing actuator 64; and it will be noted from FIG. 6 that a duplicate bellcrank arrangement with a pin 64' for rotary-oscillation pick-off is provided at the other longitudinal end of the print head 27, to enable engagement with rocker-arm means 78 in the event it is desired to mount the head 27 in its end-for-end reversed position, as when the characterized surface must be printed upside-down with respect to the orientation implicit in the setup depicted in FIG. 6.

The print head 27 and its described drive will be understood to be serial-number indexable via bellcrank actuator 64 regardless of the small leveling adjustment which may have to be made in the setting of clamp bolts 53–54–55, to assure quality printing at the plane of the characterizing surface 27'. Other parts of the printing-head unit 20 do not require such precision adjustment and are therefore mounted to the upper base plate 50. These other parts utilize side-arm plates 80–81 to provide outboard-bearing support for supply-reel and pick-up reel mandrels 82–83 serving continuous pigmented web 84 (e.g., mylar film, with a magnetic-ink pigmented coating). As best seen in FIG. 4, the pigmented web 84 supplied from a roll mounted at 82 is guided by parallel rollers 85–86 in the plane of the characterized surface 27', for impact-transfer of pigment to the web to be printed. The pigmented web 84 is thence guided over a capstan or drive roll 87, and over a further guide roller 88 prior to take-up on a reel mounted upon take-up mandrel 83. A stalled-torque electric motor 89 (FIG. 5) applies continuous slack-take-up torque to mandrel 83, via gear means 90, and a bevel-gear pick-off connection 91 from the shaft between couplings 68–68" provides a continuous metering-advance drive to the capstan roll 87 via a speed-reducing worm connection 92. A spring-loaded arm for a pressure roll 93 assures no-slip uniform metering of pigmented-web displacement, regardless of the extent to which a given supply of web 84 has been paid-out from mandrel 82. Further plate or bracket elements, as at 94–95–96, are also fixed in relation to the upper base plate 50, to assure accurate journaled support of the described web-handling roller system 85–8–6–87–88, as will be understood.

THE PRINTING-HAMMER UNIT 21

In FIG. 4, the printing-hammer unit is shown to be clamped by a knob-headed bolt 98 to the lower transverse member 26 of the machine frame. The hammer unit 21 is, like the printing-head unit 20, also transversely positionable, in that the square base plate 99 of unit 21 is guided by and between parallel transverse rails 100 secured to member 26, it being understood that bolt 98 passes through a transversely elongate slot in member 26, with threaded engagement to the base plate 99. The guide rails 100 need not be of great thickness, and thus upon relatively small release and back-off of bolt 98, the printing-hammer unit 21 with its base plate 99 need only be lifted enough to clear rails 100 in order to permit manually indexed displacement of unit 21 about its center, thus reorienting the elongation of anvil 48 to accord with a similarly indexed re-orientation of the printing-head unit 20 (e.g., from FIG. 1 to FIG. 3 orientation, or vice versa).

Figure 7:
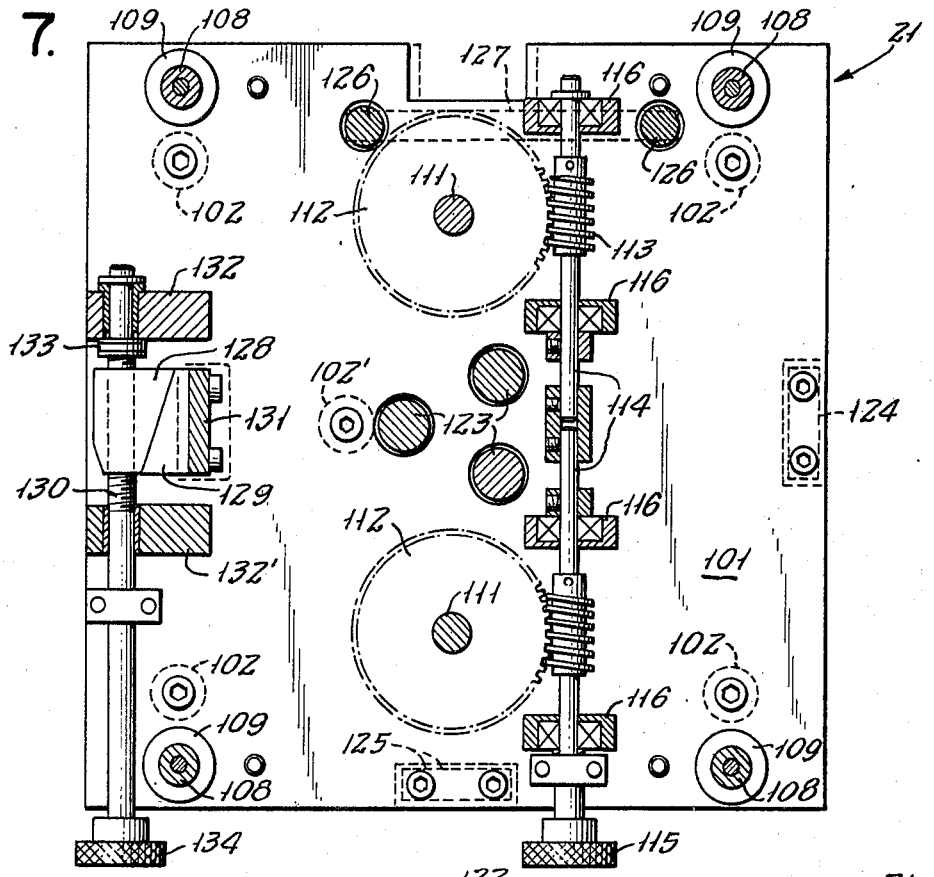
FIG. 7 is a sectional view of the printing-hammer unit of FIG. 4, taken from the aspect 7—7 of FIG. 4.
Figure 8:
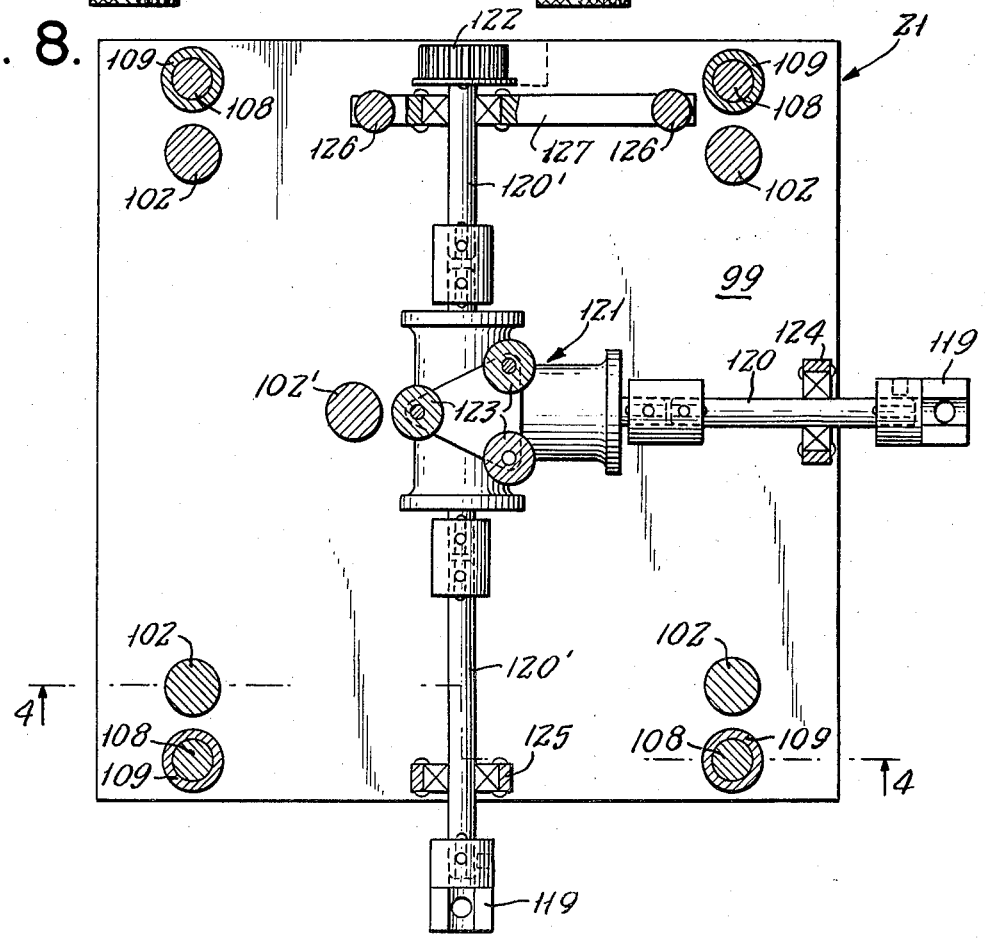
FIG. 8 is a simplified view of drive elements of the printing-hammer unit of FIG. 4, taken from the aspect 8—8 of FIG. 4.

Referring additionally to FIGS. 7 and 8 in the context of the lower half of FIG. 4, the printing-hammer unit 21 will be seen to be referenced to a primary frame defined by the base plate 99 and by an upper plate 101 secured thereto via plural spacer posts 102, one such post being provided at each corner region, and a fifth such post 102' being shown in the central region of the primary frame. Adjustably positionable above the primary frame is a plate 103 upon which is secured the frame 104 supporting the print hammer 49, for pivoted hammer action about a pivot shaft 49'; the print-hammer frame will be understood to include a tie bar 105 extending between spaced parallel side plates, the same being shown in FIG. 4 to be equipped with a stiffly compliant and suitably damped stop fitting to arrest each printing stroke of the hammer 49, without noticeable chatter. As in the case of said U.S. Pat. No. 3,254,596, the hammer 49 includes an elongate follower edge or tang, tracking the rise and then the drop of a cam shaft 106 journaled in the side plates of frame 104 and continuously driven by means to be later described. Hammer 49 is constantly loaded to track cam 106, by a stiffly compliant cantilevered leaf spring, forming part of adjustable preload mechanism, pivotally mounted at 107 between the side plates of frame 104 and also to be more fully described.

The hammer assembly including plate 103 is guided for vertical adjustment with respect to the primary frame 99–101–102 by way of a rod 108 (fixed to plate 103) and a coacting sleeve 109 (fixed to plate 101) at each of the corner regions, as best seen in FIGS. 7 and 8, and preloading spring means 110 (see FIG. 4) in each engagement of a cooperating rod 108 and sleeve 109 provides a float action for relatively frictionless fine adjustment of the elevated position of plate 103 (i.e., of the hammer). Adjustment of elevation is provided by a pair of like jack screws 111, which may be threaded to plate 103 beneath and in general registration with the anvil 48 of the hammer, and spaced along the elongation axis of anvil 48. The jack screws have ball-and-socket reference to the primary frame at the upper plate 101 and are actuated in unison by like worm wheels 112, driven by worms 113 ganged to a single shaft or to coupled shafts 114, with external actuating-knob access at 115. Shafts 114 are preferably journaled in brackets 116 mounted to plate 101.

Continuous synchronized drive to the printing-hammer unit 21 is provided in much the same manner as described for the printing-head unit except that for unit 21 the 1:1 pick-off is via a bevel-gear unit 117 having keyed engagement to the lower shaft 30 and providing an output via detachable coupling means 118. The coupling means 118 will be understood to have a degree of universal-joint action as described at 66 and to be selectively connectable to one of two orthogonally related input connections 119–119' forming part of the hammer unit 21. The two coupling elements are on orthogonal shaft alignments 120–120' which are continuously 1:1 related via bevel-gear connection at 121, and provide an output at a toothed wheel 122 for 1:1 toothed-belt connection to the print-hammer trip cam shaft 106. In order to accommodate any and all elevation adjustments of the hammer mechanism (i.e., of plate 103), the described shafting 120–120', although housed in the space between the plates 99–101 of the primary structure, is nevertheless fully suspended from and therefore continuously and consistently referenced to the adjustably elevated structure. Thus, suspension posts 123 pass with clearance through holes in plate 101 and rigidly secure the bevel-gear unit 121 to the underside of the adjustably elevated plate 103; similarly, brackets 124–125 and posts 126 (with a stabilizing interconnection 127) rigidly connect plate 103 to bearing mounts for the shafting 120–120', with suitable clearance at passage through the plane of plate 101.

The preloading spring assembly for the hammer 49 has been indicated to be adjustable and to be pivoted on the shaft 107 between side plates of the frame 104. The preload-adjustment feature is best shown in FIGS. 4 and 7 to involve coacting wedge elements 128–129, one (128) of which is threaded to a lead screw 130, and the other (129) of which is mounted to a crank arm 131 forming part of the pivoted preload-spring assembly. The shaft of lead screw 130 is journaled in spaced brackets 132–132' fixed to plate 101, and the mounting includes thrust-bearing means 133 to assure axial-position retention of the lead screw. The shaft of the lead screw extends externally of unit 21 and terminates with a knob 134 for manual setting of the lead screw and, hence, of the wedge coaction by which preload of the leaf springs on hammer 49 may be varied, for example, to adapt print-hammer action to the weight or number of plies of web 17 to be imprinted.

OPERATION

Except for the indexing feature which characterizes the present invention, operation of the document printer of this invention is very much like that described in the case of U.S. Pat. No. 3,254,596, and, therefore, no need is seen for elaborate explanation. The important thing is that, regardless of the orientation desired for printing alignment with respect to the direction of web feeding, there is never any need to change the direction of web feeding. Of course, it will be necessary to accommodate the web-advance per print cycle to the size of document to be printed; this, it will be recalled, is merely a matter of change-gear selection at 42, with phase-adjustment at 39 to assure accuracy of print-impression placement on each document, in the direction of web displacement.

To make a change in set-up, as from the orientation of FIG. 1 to that of FIG. 3, the hand knob 115 should first be operated to lower the printing mechanism, thus gaining clearance to enable the described indexing procedure, involving disconnection and reconnection of drive couplings, as appropriate. Alternatively, clearance may be obtained by a releasing operation of clamp knobs 62, to permit removal of the printing head 27 as a unit. Once the coupling connections have been established for the newly indexed position of units 20 and 21, clamps 98 and 53–54–55 should be set. Trial print cycles will be necessary to enable print-hammer elevation (knob 115), printing-head leveling (knobs 53–54–55) and hammer preload (knob 134) to be adjusted for an optimum quality of printed product; whereupon, the print wheels of the head 27 should be set to enable the job to start with a serial number selected to precede that called for by the job to be run. The knob access at 76 to removable connection of the serial-number indexing mechanism will be understood to assure against loss of serial-number setting, or to enable small correction of serial-number setting, as may be needed in the course of job set-up. Having accomplished the foregoing, the job is set for fully automatic operation, at a web speed appropriate to the web material, the same being available for selection at means 135 in front of the operator. It will be understood that, whatever the selected feed speed, all described syncronizing connections will still assure the necessary and correct synchronization of printing impression, serial-number advance, and pigmented-web advance, because all synchronization adjustments are in relation to web feed.

ON-LINE USE

Figure 9:
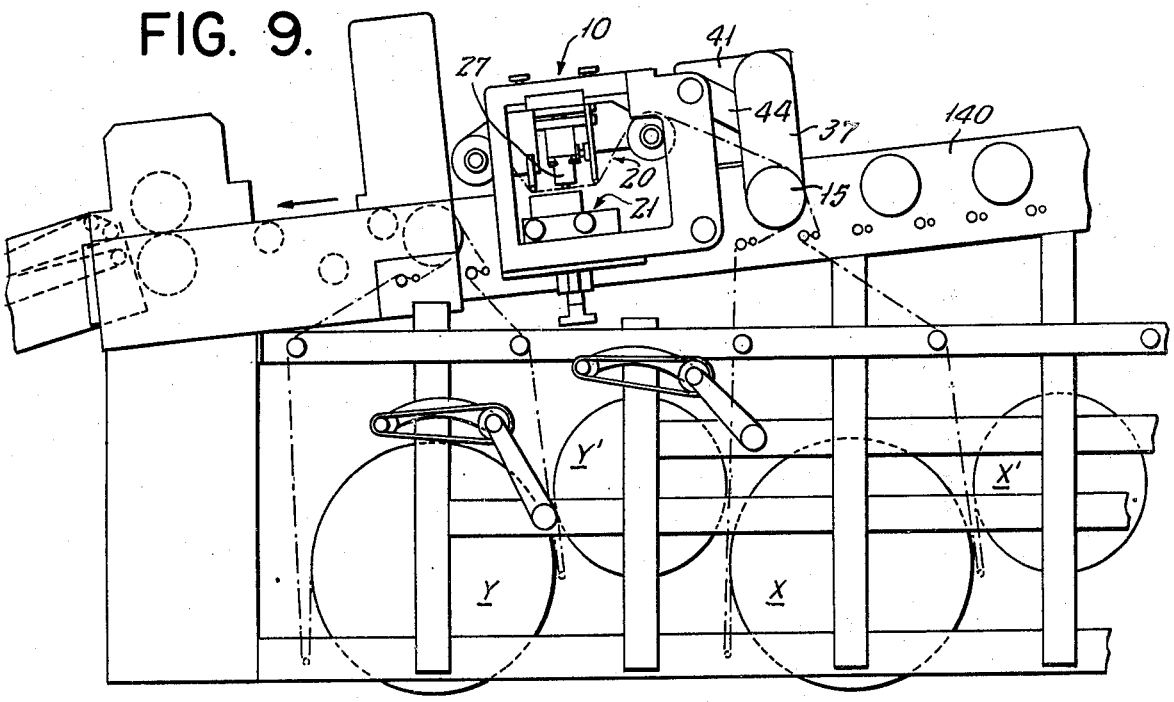
FIG. 9 is a simplified, fragmentary view in side elevation of a standard collating machine into which the machine of FIG. 1 has been integrated for on-line use.

FIG. 9 will be recognized as a simplified and fragmentary view in side elevation to show a standard collating machine to which the document printer 10 of the invention has been applied at an illustrative single-ply or multiple-ply station X, just prior to the addition of the last ply to the collated product, from the last-ply supply at Y, interleaving carbon web being supplied at X′ and Y′. The frame support which has previously been described as being provided by the table or stand 11 is now provided by the top and side surfaces of the inclined upper frame 140 of the collator, "Web-in" feed roller 15 being an existing feature of the collator, and the synchronizing pickoff 36 (within casing 37) being taken directly via sprocket connection to the existing collator shaft, for roller 15. The product of such document printing within the collator, i.e., integrated into the collating process, is thus a fully integrated multiple-part product, which requires no further operations, following such final operations as cut-off, and delivery, as may be specified for the product. It goes without saying that if different printing operations are to be performed on different plies of the product to be collated, then a duplicate document printer 10 of the invention may be assembled to the collator at the station identifiable with the further ply or plies to be thus differently printed. Whatever the number of document printers 10 thus integrated into the collating machine, the problems of synchronization are in no way complicated by the fact of integration, being at all times a function of web feed, a function already provided at each station of the collator.

The described invention will be seen to have achieved all stated objects and to provide a machine of great flexibility, inherent economy and ease of set up, whether for on-line or for off-line use. Since "right-side up" or "upside-down" orientation of print impression (with respect to pre-existing printed matter on the document web) is a simple matter of correct end-for-end mounting of the print head 27 in the block 61 and clamps 62, there is no frequent need for more than the described two orthogonally related indexed positions of units 20–21. But it will be clear that if further-indexed positions are needed, then it is a simple matter to provide additional coupling elements as at 68″ to the printing-head unit 20 or at an extension of shaft 120′ beyond wheel 122 of the printing-hammer unit 21, in order to obtain the additional indexing capability. Of course, to accommodate clamp bolts 53–54–55 to such further indexed position of unit 20, the described pattern of tapped holes in plate 50 will require such further holes at locations denoted by phantom outline at F and G in FIG. 5.

While the invention has been described in detail for the preferred forms shown, it will be understood that modifications may be made without departure from the claimed scope of the invention.

What is claimed is:

1. In a printing machine comprising a frame, a printing-head unit carried by said frame and including a printing head having an elongate characterized relief to be cyclically printed in essentially a single plane at spaced locations on a moving web, web-guiding and feeding means on said frame for continuously advancing said web in said plane adjacent said printing head, and a print-hammer unit carried by said frame and having an elongate anvil in facing registration with the characterized relief of said printing head, the improvement wherein each of said units is indexibly mounted to said frame about an index axis normal to said plane, and synchronizing-connection means between said printing-hammer unit and said feeding means for synchronizing operation of said printing-hammer unit with said feeding means for each selected one of a plurality of orientations of anvil and relief elongations with respect to the direction of web advance.

2. The improvement of claim 1, in which the rotational extent of indexible mounting about said axis is at least 90 degrees between a first orientation wherein the elongation of said characterized relief and of said anvil is transverse to the direction of movement of adjacent web and a second orientation wherein the elongation of said characterized relief and of said anvil is in the direction of movement of adjacent web.

3. The improvement of claim 2, in which the rotational extent of indexible mounting about said axis is at least 180 degrees between one of said first and second orientations and a third orientation diametrically opposed to said one orientation.

4. The improvement of claim 2, in which first and second angle-locating means are operative between said units and said frame to locate a selected one of said two orientations.

5. The improvement of claim 4, in which releasable clamping means is associated with each of said units for securing a selected one of said angle-located orientations.

6. The improvement of claim 2, in which said synchronizing-connection means comprises a rotary-power take-off drive element journaled in said frame, and two rotary-power take-off driven connection elements journaled in said print-hammer unit on orthogonally related connection axes, said printing-hammer unit being optionally operable by either of said two connection elements, and each of said two connection elements being selectively connectable to said power take-off drive element for a different one of said two orientations.

7. The improvement of claim 2, in which said printing-head unit includes mechanism to be driven in cyclical synchronism with operation of said printing-hammer unit, and synchonizing actuating-connection means for said mechanism, said actuating-connection means comprising a power take-off drive element journaled in said frame, and two power take-off driven elements journaled in said printing-head unit on orthogonally related connection axes, said printing-head unit mechanism being optionally operable by either of said two driven elements, and each of said two driven elements being selectively connectable to said power take-off drive element for a different one of said two orientations.

8. The improvement of claim 7, in which said printing-head unit mechanism includes means for supporting and feeding pigmented ribbon substantially in said plane and between the web and said characterized relief.

9. The improvement of claim 8, in which said mechanism further includes a print wheel in said printing head, and actuating means for changing the print-wheel position to change the characterized relief to be printed, said actuating means being optionally operable by either of said two driven elements.

10. The improvement of claim 1, in which the mounting of said printing-head unit to said frame is independently slidably adjustable on a first frame-based guide extending transverse to the direction of web movement, and in which the mounting of said printing-hammer unit to said frame is independently slidably adjustable on a second frame-based guide extending transverse to the direction of web movement, each of said units being independently indexible about its own index axis.

11. The improvement of claim 10, in which both said index axes are in a single plane that is transverse to the direction of web movement.

12. The improvement of claim 10, in which releasable clamping means is associated with each of said units for securing a selected frame-based mounting thereof.

13. The improvement of claim 1, in which said printing head is so carried by said printing-head unit as to position the elongation axis of the characterized relief on an alignment through the index axis of said printing-head unit, and in which said anvil is so carried by said printing-hammer unit as to position the elongation axis of said anvil on an alignment through the index axis of said printing-hammer unit.

14. The improvement of claim 13, in which said units are mounted for independently indexible orientation, whereby a given printing-hammer mounting orientation may serve either of two 180-degree indexed mounting orientations of said printing-head unit.

15. The improvement of claim 1, in which said printing head includes numerical printing indicia and actuating means for changing numerical indicia in said characterized relief, and synchronizing-connection means between said actuating means and said feeding means for synchronizing operation of numerical-indicium change in interlaced sequence with operation of said printing-hammer unit for each selected one of said orientations.

16. In a printing machine comprising a frame, a printing-head unit carried by said frame and including a printing head having a elongate characterized relief to be cyclically printed in essentially a single plane at spaced locations on a moving web, web-guiding means for positioning web material in said plane adjacent said printing head, continuous-drive means including web-feeding means for continuously advancing web material in said plane and through registry with said printing head, and a print-hammer unit carried by said frame and having an elongate anvil in facing registration with the characterized relief of said printing head, the improvement in which said continuous-drive means includes a frame-based shaft extending transversely of the direction of web movement and on the printing-hammer unit side of the path of web movement, and in which each of said units is selectively positionable in a transverse guide forming part of said frame and is also indexibly securable to said frame about an index axis normal to said plane, a rotary-power take-off drive element slidably positionable along but keyed against rotation with respect to said shaft, said printing-hammer unit including separate rotary-power take-off driven elements on each of two 90-degree spaced orientations about the index axis of said printing-hammer unit, and each of said driven elements being selectively connectable to said power-take-off drive element for a different one of said two orientations.

17. The improvement of claim 16, in which in one of said orientations the elongation of said anvil is transverse to the direction of adjacent web movement and in the other of said orientations the elongation of said anvil is in the direction of adjacent web movement.

18. The improvement of claim 16, in which said continuous-drive means includes a second frame-based shaft extending transversely of the direction of web movement and on the printing-head unit side of the path of web movement, and in which said printing-head unit includes mechanism to be shifted in synchronism with operation of said printing-hammer unit, a rotary-power take-off drive element slidably positionable along but keyed against rotation with respect to said second shaft, said printing-head unit including separate rotary-power take-off driven elements on each of two 90-degree spaced orientations about the index axis of said printing-head unit, and each of said last-mentioned driven elements being selectively connectable to said last-mentioned power-take-off drive element for a different one of the two orientations of said printing-head unit.

19. The improvement of claim 18, in which for one of the indexed orientations of said units the elongations of said characterized relief and of said anvil are in register and transverse to the direction of web movement therebetween, and in which for the other of the indexed orientations of said units the elongations of said characterized relief and of said anvil are in register and aligned with the direction of web movement therebetween.

20. The improvement of claim 16, in which said indexible printing-hammer unit includes spring means preloading said anvil in the direction of approach to said printing-head, and cam means continuously connected to both said driven elements for cyclically operative cammed retraction of said anvil against said spring means and release of said anvil for spring-driven transient print-impressing impact with the web.

21. The improvement of claim 20, in which said indexible printing-hammer unit includes selectively operable adjustable means for preloading said spring means.

22. The improvement of claim 20, in which said indexible printing-hammer unit includes a main unit frame and an auxiliary frame, said hammer and spring means and cam means being carried by said auxiliary frame, and selectively operable means for adjustably setting the position of said auxiliary frame with respect to said main frame and in the direction to variably determine the magnitude of print-impression gap between said relief and said anvil.

23. The improvement of claim 16, in which change-gear means is included in the continuous-drive means connection of one to the exclusion of the other of (a) said shaft and (b) said web-feeding means, for selective determination of web-feeding advance for each cycle of printing-hammer operation.

24. The improvement of claim 16, in which said drive means includes selectively operable means for adjusting the phase relation of continuous running of said web-feeding means and of said shaft with respect to each other.

25. In a printing machine comprising a frame, a printing-head unit carried by said frame and including a printing head having an elongate characterized relief to be cyclically printed in essentially a single plane at spaced locations on a moving web, web-guiding means for positioning web material in said plane adjacent said printing head, continuous-drive means including web-feeding means for continuously advancing web material in said plane and through registry with said printing head, and a print-hammer unit carried by said frame and having an elongate anvil in facing registration with the characterized relief of said printing head, the improvement in which said continuous-drive means includes first and second parallel frame-based rotary shafts extending transversely of the direction of web movement and on opposite sides of the path of web movement, and in which said units are selectively positionable in transverse guide means forming part of said frame, said units being indexibly securable to said frame about an index axis normal to said plane, a separate rotary-power take-off drive element slidably positionable along but keyed against rotation with respect to each said shaft, each of said units having rotary-power take-off driven-element means which is operably associated with the power take-off drive element on its side of the path of web movement, such operable association being for each of two 90-degree spaced orientations of said units about said index axis.

* * * * *